US008529098B2

(12) United States Patent
Lee et al.

(10) Patent No.: US 8,529,098 B2
(45) Date of Patent: Sep. 10, 2013

(54) LIGHT EMITTING DIODE DEVICE WITH EFFECTIVE HEAT DISSIPATION

(75) Inventors: Hsiao-Wen Lee, Hsinchu (TW); Hsueh-Hung Fu, Hsinchu (TW); Jin-Hua Wang, Xinzhuang (TW); Chien-Liang Yeh, Yilan (TW)

(73) Assignee: TSMC Solid State Lighting Ltd., Hsinchu (TW)

( * ) Notice: Subject to any disclaimer, the term of this patent is extended or adjusted under 35 U.S.C. 154(b) by 398 days.

(21) Appl. No.: 12/940,151

(22) Filed: Nov. 5, 2010

(65) Prior Publication Data

US 2012/0113639 A1 May 10, 2012

(51) Int. Cl.
*F21V 29/00* (2006.01)

(52) U.S. Cl.
USPC ..... 362/294; 362/373

(58) Field of Classification Search
USPC ..... 362/294.02, 373; 313/12, 46
See application file for complete search history.

(56) References Cited

U.S. PATENT DOCUMENTS

2010/0265709 A1* 10/2010 Liu ..... 362/249.02

FOREIGN PATENT DOCUMENTS

TW 2008-21500 12/2002
TW M358259 U1 6/2009

* cited by examiner

*Primary Examiner* — Mary Ellen Bowman
(74) *Attorney, Agent, or Firm* — Haynes and Boone, LLP

(57) ABSTRACT

The present disclosure relates to light emitting diode (LED) devices and methods for fabricating the same. An LED device includes a housing adapted to combine a heat sink with a vapor chamber to form an enclosed space interposed therebetween. The LED device includes light emitting diode modules attached to the housing adjacent to the vapor chamber. The vapor chamber is adapted to uniformly disperse heat generated from the LED modules within the enclosed space to form a uniform temperature field on the heat sink to thereby provide effective heat dissipation.

20 Claims, 7 Drawing Sheets

| MODEL | Vh | Ih | Vf | Tcase | Tj (CALCULATION) | Rt (CALCULATION) |
|---|---|---|---|---|---|---|
| | V | mA | V | C | C | C/W |
| COMBINE VH | 13.538 | 100 | 12.306 | 31.7 | 33.39 | 1.2 |

| MODEL | Vh | Ih | Vf | Tcase | Tj (CALCULATION) | Rlens (CALCULATION) |
|---|---|---|---|---|---|---|
| | V | mA | V | C | C | C/W |
| NO VH | 13.232 | 100 | 11.952 | 70.7 | 79.11 | 6.4 |

LIGHT EMITTING DIODE DEVICE WITH EFFECTIVE HEAT DISSIPATION

BACKGROUND

Conventional light emitting diode (LED) devices often include several package-type components, depending on their application. One common component is a heat sink to dissipate heat generated during operation. Centralizing heat flux and the large thermal density of LEDs sometimes requires a heat sink with a large heat transfer area to dissipate the heat. Another common component is a waterproof housing to protect an internal power supply from water damage. Assembly of this housing can be difficult, and if the housing is damaged or the power supply is problematic, maintenance can be difficult. Yet another common component is a reflector to direct light (radiation) emanating from the LED through a central lens area. Often, light intensity is diminished as a result of this component.

There is a continuing need to improve LED devices, including their manufacture and operation. These improvements include, but are not limited to, improving one or more of the above-listed package-type components.

BRIEF DESCRIPTION OF THE DRAWINGS

The present disclosure is best understood from the following detailed description when read with the accompanying figures. It is emphasized that, in accordance with the standard practice in the industry, various features are not drawn to scale and are used for illustration purposes only. In fact, the dimensions of the various features may be arbitrarily increased or reduced for clarity of discussion. It should be appreciated that like reference numerals are used to identify like elements illustrated in one or more of the figures.

DETAILED DESCRIPTION

Figure 1A:
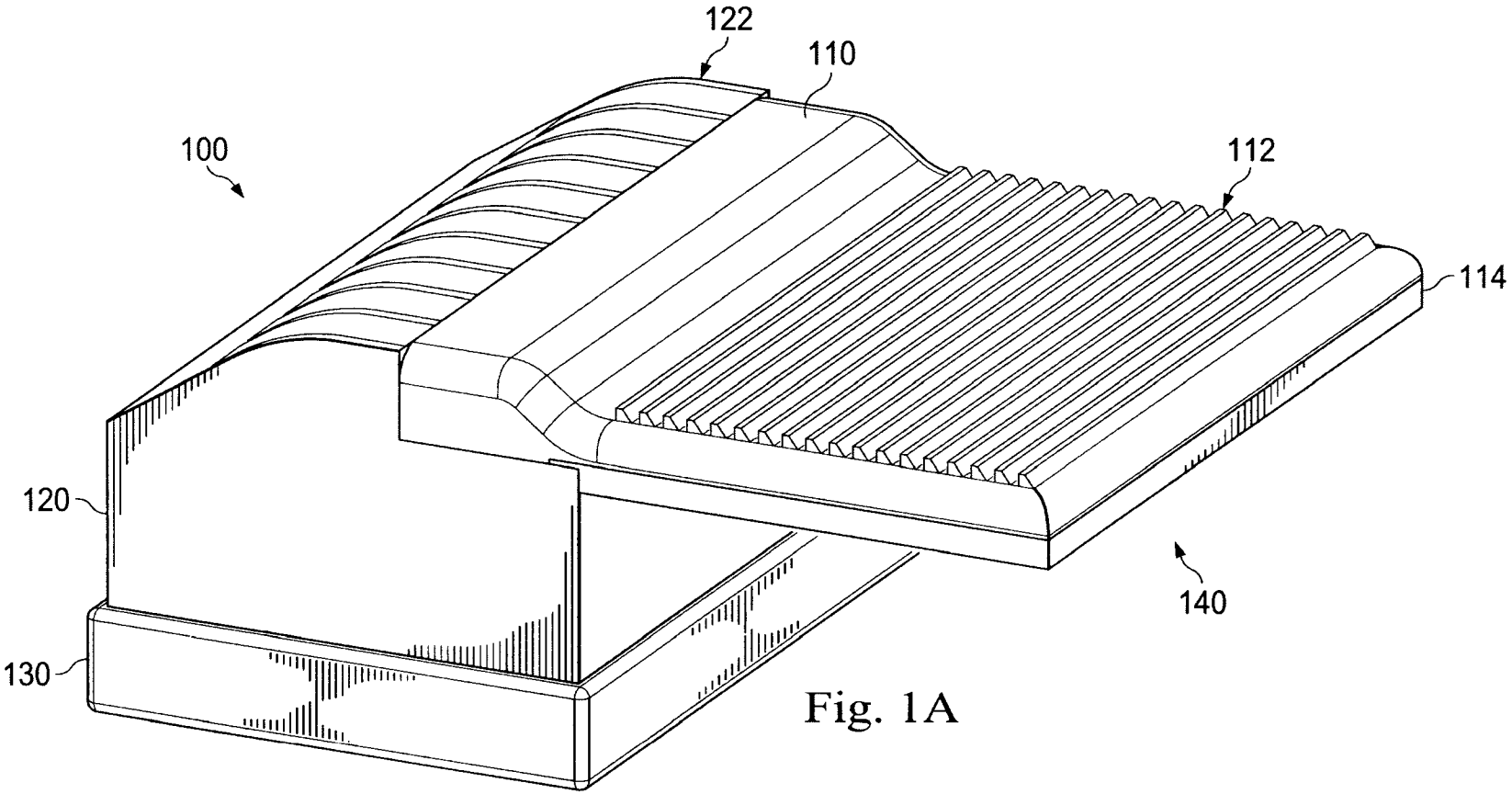
FIGS. 1A-1D show a light emitting diode (LED) device with a luminaire housing, in accordance with an embodiment of the present disclosure.

It is understood that the present disclosure provides many different embodiments, and that these embodiments are provided only as examples of systems, devices and methods that can benefit from the present invention. The invention itself should not be limited to any of these embodiments. Also, in the drawings, the sizes and relative sizes of layers and regions may be exaggerated for clarity. Furthermore, it will be understood that when an element or layer is referred to as being "on," or "coupled to" another element or layer, it may be directly on, or coupled to the other element or layer, or intervening elements or layers may be present.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as being "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein may likewise be interpreted accordingly.

Hereinafter, embodiments of the present invention will be explained in detail with reference to the accompanying drawings.

Embodiments of the present disclosure relate to a light emitting diode (LED) device having an improved luminaire housing with effective heat dissipation. In one aspect, the luminaire housing combines a heat sink and a vapor chamber together to provide effective heat dissipation by reducing thermal resistance and increasing heat transfer rate. In another aspect, use of the vapor chamber allows a reduced heat sink dimension along with other advantages as described in greater detail herein.

FIGS. 1A-1D show a light emitting diode (LED) device 100 with a luminaire housing 110, in accordance with an embodiment of the present disclosure.

Figure 1B:
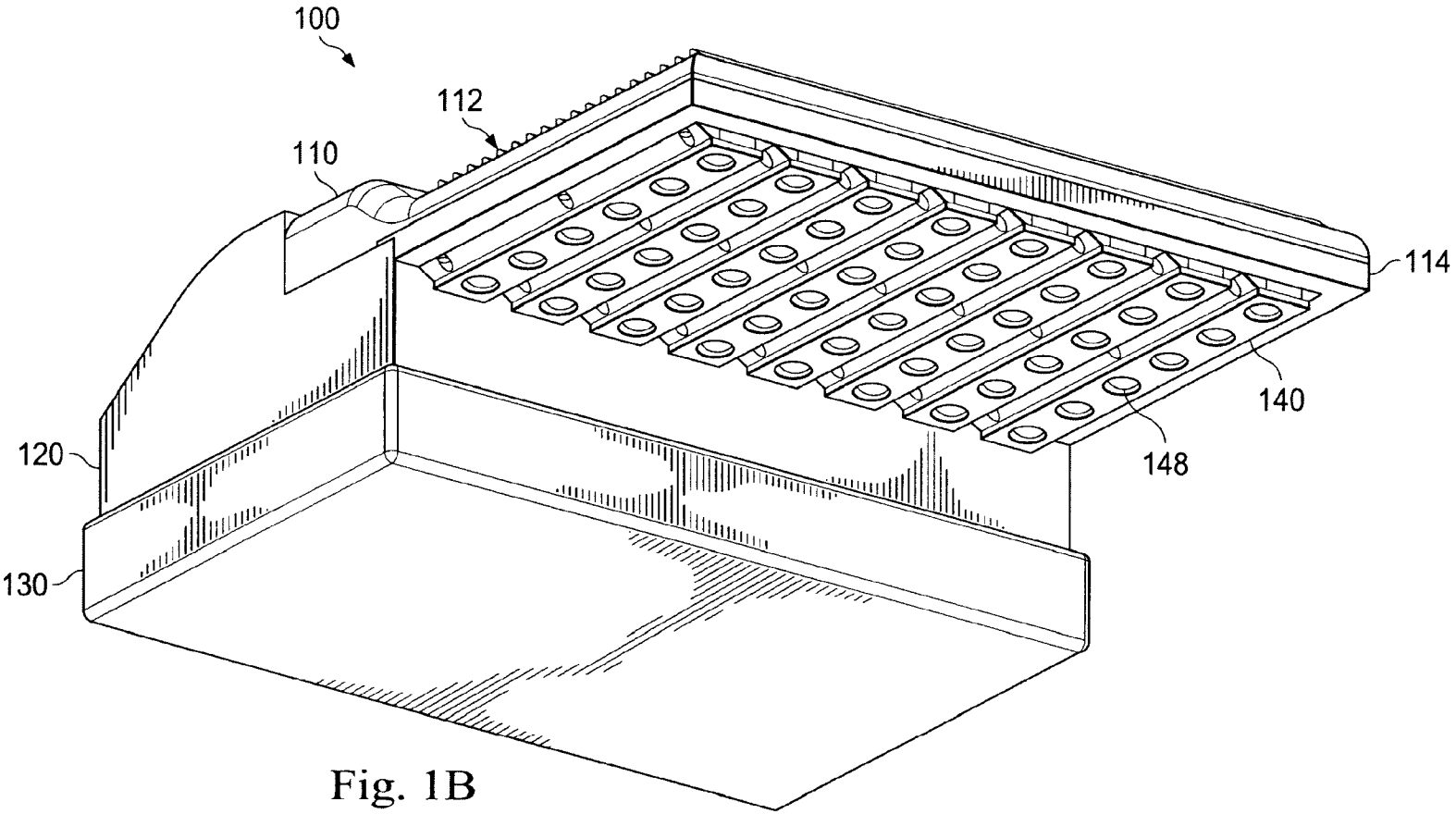
Figure 1C:
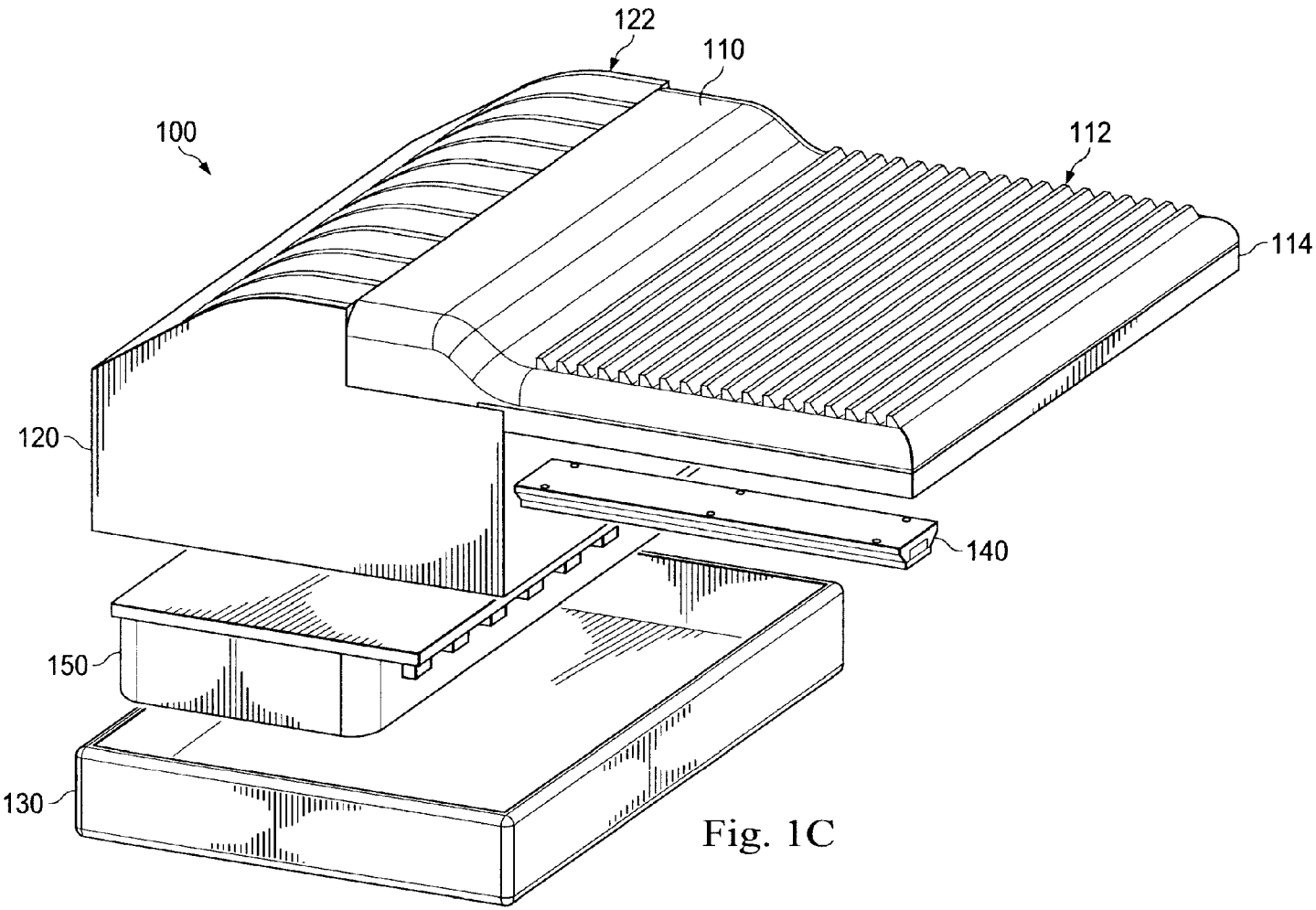

FIG. 1A shows the LED device 100 comprising the luminaire housing 110 with heat sink 112 and vapor chamber 114, a control box 120 with heat sink 122, a cover 130, and one or more LED modules 140. FIG. 1B shows a plurality of LED modules 140 attached to the luminaire housing 110. FIG. 1C is an exploded view of the LED device 100. As shown in FIG. 1C, the LED device 100 comprises a controller and power supply 150.

Referring to FIG. 1B, the housing 110 comprises a lighting structure adapted to receive one or more LED modules 140 for attachment thereto. In one aspect, each of the LED modules 140 are adapted to be waterproof. The control box 120 is adapted to receive the housing 110 for attachment thereto. In one aspect, the housing 110 is adapted to be attached to the control box 120 for waterproof assembly. The control box 120 is adapted to receive the controller and power supply 150 for attachment thereto. The control box 120 is adapted to receive the cover 130 for attachment thereto. In one aspect, as shown in FIG. 1C, the controller and power supply 150 are adapted to be attached to the control box 120 and enclosed by the cover 130 for waterproof assembly. In another aspect, as long as the LED modules 140 and the control box 120, which has the installed controller and power supply 150, have a waterproof function, the LED modules 140 may be directly mounted to the housing 110. Accordingly, assembly of the LED device 100 is simplified because each component thereof is already waterproof prior to assembly.

Figure 1D:
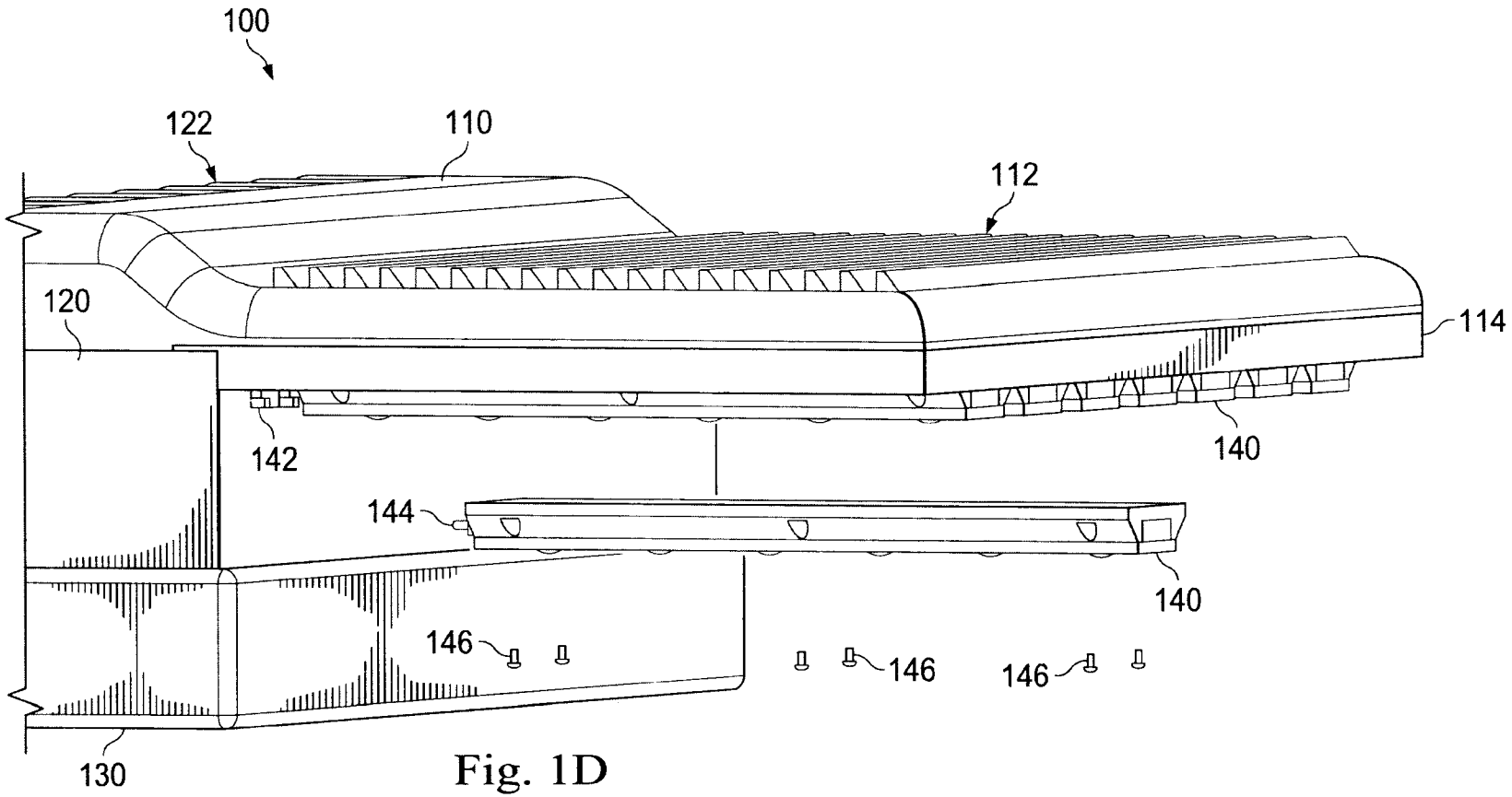

FIG. 1D shows assembly of the LED module 140 to the luminaire housing 110. As shown in FIG. 1D, the housing comprises one or more electrical connectors 142 that are adapted to receive an electrical connector 144 of each corresponding LED module 140. In one aspect, each LED module 140 comprises at least one electrical connector 144 that corresponds to electrical connectors 142 of the housing 110 so that the housing is adapted to be electrically connected to a plurality of LED modules 140 as shown in FIG. 1B. In another aspect, the electrical connectors 142, 144 are adapted to provide the LED modules 140 with an electrical connection to the controller and power supply 150 within the control box 120 for operation of the LED modules 140.

As shown in FIG. 1D, the LED modules 140 may be attached to the housing 110 with one or more fasteners 146, such as screws, rivets, etc. In one aspect, the LED modules 140 may be directly and securely mounted to the housing 110 with the connectors 142 and/or the fasteners 146. In another aspect, the LED modules 140 may be attached to the housing 110 with an adhesive, such as glue, resin, epoxy, etc., without departing from the scope of the present disclosure.

Referring to the housing 110, the vapor chamber 114 may be adapted to transfer heat from the LED modules 140 to the heat sink 112 uniformly and quickly. The heat sink 112 is adapted to dissipate heat. In one aspect, some convection cooling of the LED modules 140 may occur, without departing from the scope of the present disclosure.

Referring to the control box 120, the heat sink 122 is adapted to dissipate heat from the controller and power supply 150. In one aspect, heat generated from the controller and power supply 150 may not be as high as heat generated from the LED modules 140. In another aspect, the controller and power supply 150 is adapted to be waterproof.

In one embodiment, the LED modules 140 comprise one or more LED components 148 adapted to emit light when voltage from the power supply 150 is applied thereto. For example, as shown in FIG. 1B, each LED module 140 may comprise a plurality of LEDs 148, such as for example 6 LEDs. In one aspect, the LED modules 140 together generate a large amount of heat that may be dissipated through the heat sink 112 of the housing 110. In another aspect, the LED modules 140 are adapted to be waterproof.

Figure 2:
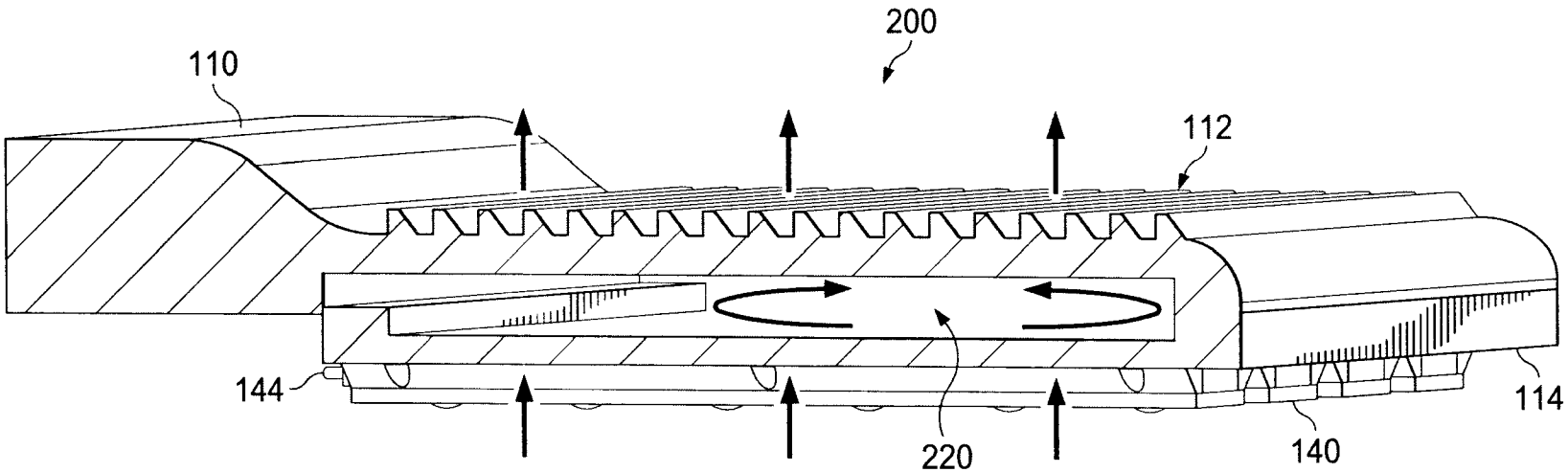
FIG. 2 shows a heat transfer method for the LED device with the luminaire housing, in accordance with an embodiment of the present disclosure.

FIG. 2 shows a heat transfer method 200 for the luminaire housing 110 of the LED device 100, in accordance with an embodiment of the present disclosure. In one aspect, as shown in FIG. 2, the housing 110 combines the heat sink 112 with the vapor chamber 114 to form an enclosed space 220 interposed therebetween. Accordingly, i.e., the vapor chamber 114 is adapted to form the enclosed space 220 in the housing 110 between the LED modules 140 and the heat sink 112. In another aspect, the housing 110 is adapted to transfer heat from the LED modules 140 to the heat sink 112 via the vapor chamber 114.

In one aspect, the LED modules 140 serve as a heat source by generating heat during operation, wherein generated heat transfers to the enclosed space 220 of the vapor chamber 112 from the LED modules 140. The vapor chamber 114 comprises the enclosed space 220 that serves as a distributed heat source by uniformly dispersing the heat transferred from the LED modules 140 throughout the enclosed space 220. The uniformly dispersed heat in the enclosed space 220 of the vapor chamber 112 transfers to the heat sink 112 in a uniform manner. The heat sink 112 serves to uniformly dissipate heat transferred from the enclosed space 220 of the vapor chamber 114.

In one aspect, the vapor chamber 114 distributes heat flux rapidly so as to form a more uniform temperature field on the heat sink 112 to thereby provide effective heat dissipation. A more uniform distribution of temperature to the heat sink 112 via the vapor chamber 114 improves overall heat dissipation of the heat sink 112. Conventional heat sink use provides non-uniform heat distribution in only a small area of a heat sink with a result of a small area of high temperature on the heat sink and a large area of low temperature on the heat sink, which is less efficient and thus ineffective.

In one implementation, the interior region of the enclosed space 220 of the vapor chamber 112 may comprise an empty space that may be filled with a working fluid, such as for example water, alcohol, etc. In one aspect, the fluid may fill the interior region defined by the enclosed space 220 of the vapor chamber 112. In another aspect, the fluid may be circulated within the enclosed space 220 of the vapor chamber 112 to more uniformly disperse heat throughout the enclosed space 220. In another aspect, under varying pressure, transferred heat may evaporate the fluid in the enclosed space 220 of the vapor chamber 112, which may then condense when cooled or upon cooling.

In another implementation, the interior region of the enclosed space 220 of the vapor chamber 112 may comprise some type of porous material that may be filled with a working fluid, such as for example water, alcohol, etc. In one aspect, the porous material may fill the interior region defined by the enclosed space 220 of the vapor chamber 112. The porous material may operate with a capillary action to circulate fluid therethrough. In another aspect, under varying pressure, transferred heat may evaporate the fluid in the enclosed space 220 of the vapor chamber 112, which may then condense when cooled or upon cooling. The porous material may increase the speed at which droplets of fluid condense.

Figure 3A:
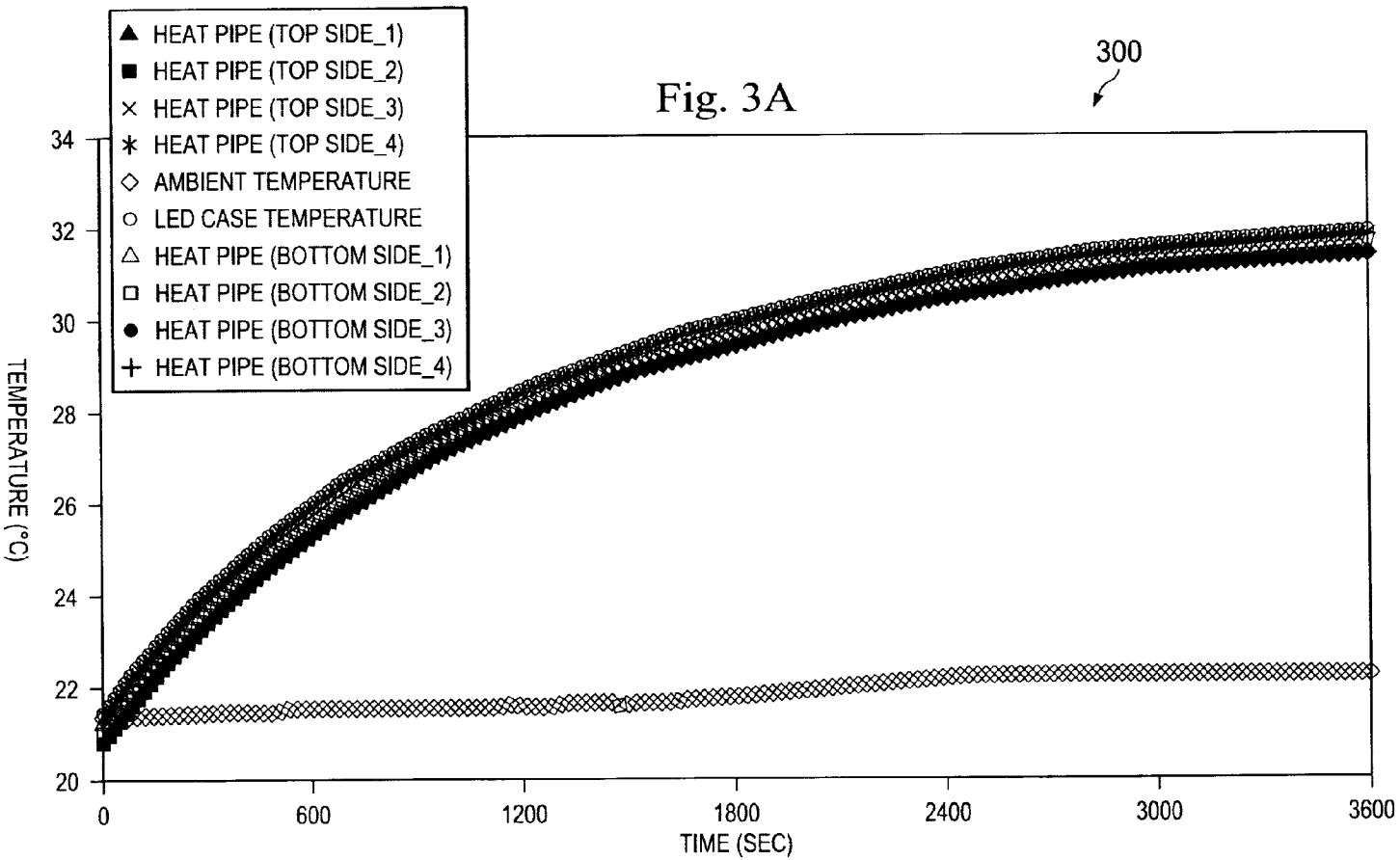
FIGS. 3A and 3B show sample simulation results for the LED device, in accordance with embodiments of the present disclosure.

FIG. 3A shows a sample simulation result 300 for temperature in degrees Celsius (° C.) versus time in seconds of the luminaire housing 110 with the heat sink 112 and the vapor chamber 114, in accordance with an embodiment of the present disclosure.

As shown in FIG. 3A, the housing 110 with the vapor chamber 114 is shown to stay cooler during the simulation 300 to at least less than approximately 32° C. over approximately 3600 seconds (i.e., 60 minutes). In one aspect, the housing 110 with the vapor chamber 114 is also shown to slowly rise in temperature at a slower rate during the simulation 300.

Accordingly, as shown in FIG. 3A, the LED luminaire housing 110 has significantly effective heat dissipation. In one aspect, the housing 110 combines the heat sink 112 and the vapor chamber 112 together to provide the enclosed space 200 for significantly effective heat dissipation. As such, the housing 110 is adapted to provide more effective heat dissipation by reducing thermal resistance and increasing the heat transfer rate.

Figure 3B:
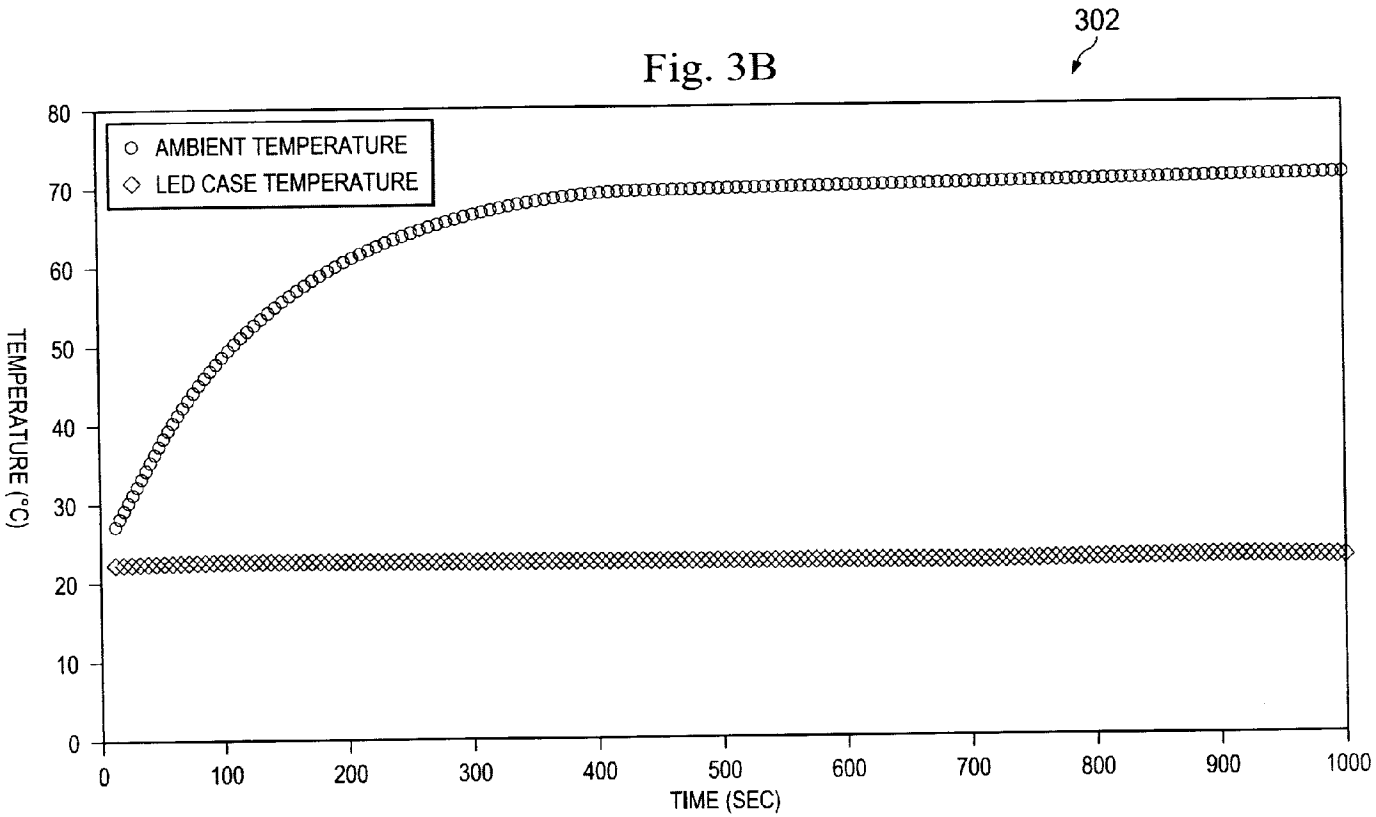

FIG. 3B shows another sample simulation result 302 for temperature in ° C. versus time in seconds of the luminaire housing 110 with only the heat sink 112 and without the vapor chamber 114, in accordance with an embodiment of the present disclosure.

As shown in FIG. 3B, the housing 110 without the vapor chamber 114 is shown to rise significantly in temperature during the simulation to approximately 70° C. over approximately 1000 seconds (i.e., about 16.5 minutes). In one aspect, the housing 110 without the vapor chamber 114 is also shown to rise rapidly to a higher temperature at a faster rate during the simulation 302 than the simulation 300 of FIG. 3A.

Therefore, as shown in FIG. 3B, the LED luminaire housing 110 without a vapor chamber 114 would have less effective heat dissipation. In one aspect, the housing 110 is simulated with only the heat sink 112, which provides less effective heat dissipation. As such, the housing 110 without the vapor chamber 114 provides less effective heat dissipation by increasing thermal resistance and inhibiting the heat transfer rate.

As described herein, embodiments of the present disclosure relate to an LED device having a luminaire housing with effective heat dissipation. The luminaire housing combines a heat sink and a vapor chamber together to provide effective heat dissipation by reducing thermal resistance and increasing heat transfer rate. In one aspect, use of the vapor chamber allows a reduced heat sink dimension along with other advantages.

In one embodiment, provided is a light emitting diode (LED) device comprising a housing having a heat sink and a vapor chamber. The housing is adapted to combine the heat sink with the vapor chamber to form an enclosed space interposed therebetween. The LED device comprises one or more LED modules attached to the housing adjacent to the vapor chamber. The LED modules are adapted to emit light and heat during operation. The vapor chamber is adapted to uniformly disperse heat generated from the LED modules within the enclosed space to form a uniform temperature field on the heat sink to thereby provide effective heat dissipation.

In various implementations, the housing may include a control box with a heat sink and a cover adapted to enclose a controller and power supply. The housing may be adapted to be attached to the control box for waterproof assembly. The controller and power supply may be adapted to be attached to the control box and enclosed by the cover for waterproof assembly. The heat sink of the control box may be adapted to dissipate heat from the controller and power supply. The LED modules may be waterproof. Each LED module may include one or more LED components adapted to emit light when voltage from the power supply is applied thereto. The LED modules may be attached to the housing with one or more fasteners including one or more screws.

In various implementations, the housing includes one or more electrical connectors, and each LED module includes at least one electrical connector that corresponds to at least one electrical connector of the housing so that the housing is adapted to be electrically connected to the LED modules. The electrical connectors may be adapted to provide each LED module with an electrical connection to the controller and power supply within the control box for operation of the LED modules. The vapor chamber of the housing may be adapted to transfer heat from the LED modules to the heat sink. The heat sink of the housing may be adapted to dissipate heat.

In one implementation, an interior region of the enclosed space of the vapor chamber may comprise an empty space that may be filled with a fluid including at least one of water and alcohol. In another implementation, the interior region of the enclosed space of the vapor chamber may comprise a porous material that may be filled with a fluid including at least one of water and alcohol. The porous material may operate with a capillary action to circulate the fluid within the enclosed space of the vapor chamber.

In another embodiment, provided is a device comprising one or more LED modules adapted to emit light and generate heat during operation, a vapor chamber adapted to disperse heat generated from the LED modules, a heat sink adapted to dissipate heat from the vapor chamber, and a housing adapted to combine the heat sink with the vapor chamber to form an enclosed space to uniformly disperse heat in the vapor chamber and to form a uniform temperature field on the heat sink to thereby provide effective heat dissipation.

In still another embodiment, provided is a heat transfer method for an LED device comprising operating one or more light emitting diode modules to emit light, the light emitting diode modules generating heat during operation, transferring heat from the light emitting diode modules to a vapor chamber, dispersing heat from the light emitting diode modules throughout an enclosed space of the vapor chamber, transferring heat from the vapor chamber to a heat sink, and dispersing heat from the heat sink. In one aspect, the vapor chamber is adapted to uniformly disperse heat from the light emitting diode modules so as to form a uniform temperature field on the heat sink to thereby provide effective heat dissipation.

Although embodiments of the present disclosure have been described, these embodiments illustrate but do not limit the disclosure. It should also be understood that embodiments of the present disclosure should not be limited to these embodiments but that numerous modifications and variations may be made by one of ordinary skill in the art in accordance with the principles of the present disclosure and be included within the spirit and scope of the present disclosure as hereinafter claimed.

What is claimed is:

1. A light emitting diode device comprising:

a housing having a heat sink and a vapor chamber, the heat sink being integrated into the housing, the vapor chamber and the heat sink collectively defining an enclosed space; and one or more light emitting diode modules attached to the housing adjacent to the vapor chamber, the one or more light emitting diode modules adapted to emit light and heat during operation, wherein the vapor chamber is adapted to disperse heat generated from the light emitting diode modules within the enclosed space to form a temperature field on the heat sink for heat dissipation.

2. The device of claim 1, wherein the housing further comprises:

a control box with a heat sink, the housing adapted to be attached to the control box for waterproof assembly; and a cover adapted to enclose a controller and power supply, wherein the controller and power supply are adapted to be attached to the control box and enclosed by the cover for waterproof assembly, and wherein the heat sink of the control box is adapted to dissipate heat from the controller and power supply.

3. The device of claim 1, wherein the light emitting diode modules are waterproof, and wherein each light emitting diode module comprises one or more light emitting diode components adapted to emit light when voltage from the power supply is applied thereto, and wherein the light emitting diode modules are attached to the housing with one or more fasteners.

4. The device of claim 2, wherein the housing further comprises one or more electrical connectors, and wherein each light emitting diode module comprises at least one electrical connector that corresponds to at least one electrical connector of the housing so that the housing is adapted to be electrically connected to the light emitting diode modules.

5. The device of claim 4, wherein the electrical connectors are adapted to provide each light emitting diode module with an electrical connection to the controller and power supply within the control box for operation of the light emitting diode modules.

6. The device of claim 1, wherein the vapor chamber is adapted to transfer heat from the light emitting diode modules to the heat sink.

7. The device of claim 1, wherein an interior region of the enclosed space of the vapor chamber comprises an empty space that is filled with a fluid including at least one of water and alcohol.

8. The device of claim 1, wherein an interior region of the enclosed space of the vapor chamber comprises a porous material that is filled with a fluid including at least one of water and alcohol, wherein the porous material operates with a capillary action to circulate the fluid within the enclosed space of the vapor chamber.

9. A device comprising:

one or more light emitting diode modules adapted to emit light and generate heat during operation;

a vapor chamber adapted to disperse heat generated from the light emitting diode modules;

a heat sink adapted to dissipate heat transferred from the vapor chamber; and a housing that includes an integrated combination of the heat sink and the vapor chamber, the vapor chamber defining a partially enclosed space to disperse heat in the vapor chamber and to form a temperature field on the heat sink to thereby provide heat dissipation.

10. The device of claim 9, wherein the housing further comprises:

a control box with a heat sink, the housing adapted to be attached to the control box for waterproof assembly; and a cover adapted to enclose a controller and power supply, wherein the controller and power supply are adapted to be attached to the control box and enclosed by the cover for waterproof assembly, and wherein the heat sink of the control box is adapted to dissipate heat from the controller and power supply.

11. The device of claim 9, wherein the light emitting diode modules are waterproof, and wherein the light emitting diode modules are attached to the housing adjacent to the vapor chamber with one or more fasteners, and wherein each light emitting diode module comprises one or more light emitting diode components adapted to emit light when voltage from the power supply is applied thereto.

12. The device of claim 10, wherein the housing further comprises one or more electrical connectors, and wherein each light emitting diode module comprises at least one electrical connector that corresponds to at least one electrical connector of the housing so that the housing is adapted to be electrically connected to the light emitting diode modules, and wherein the electrical connectors are adapted to provide each light emitting diode module with an electrical connection to the controller and power supply within the control box for operation of the light emitting diode modules.

13. The device of claim 9, wherein the vapor chamber is adapted to transfer heat from the light emitting diode modules to the heat sink.

14. The device of claim 9, wherein an interior region of the partially enclosed space of the vapor chamber comprises an empty space that is filled with a fluid including at least one of water and alcohol.

15. The device of claim 9, wherein an interior region of the partially enclosed space of the vapor chamber comprises a porous material that is filled with a fluid including at least one of water and alcohol, wherein the porous material operates with a capillary action to circulate the fluid within the partially enclosed space of the vapor chamber.

16. A heat transfer method for a light emitting diode device, the method comprising:

operating one or more light emitting diode modules to emit light, the light emitting diode modules generating heat during operation;

transferring heat from the light emitting diode modules to a vapor chamber;

dispersing heat transferred from the light emitting diode modules throughout an enclosed space of the vapor chamber;

transferring heat from the vapor chamber to a heat sink that is an integrated part of a housing for the one or more light emitting diode modules; and dispersing heat from the heat sink, wherein the vapor chamber is adapted to disperse heat from the light emitting diode modules so as to form a temperature field on the heat sink to thereby provide heat dissipation.

17. The method of claim 16, wherein:

the heat sink and the vapor chamber collectively define an enclosed space to disperse heat in the vapor chamber and to form a temperature field on the heat sink to thereby provide heat dissipation, and the light emitting diode modules are attached to the housing adjacent to the vapor chamber and each light emitting diode module comprises one or more light emitting diode components adapted to emit light.

18. The method of claim 16, wherein: the light emitting diode modules are waterproof, and the heat sink is waterproof.

19. The method of claim 16, wherein an interior region of the enclosed space of the vapor chamber comprises an empty space that is filled with a fluid including at least one of water and alcohol.

20. The method of claim 16, wherein an interior region of the enclosed space of the vapor chamber comprises a porous material that is filled with a fluid including at least one of water and alcohol, wherein the porous material operates with a capillary action to circulate the fluid within the enclosed space of the vapor chamber.

* * * * *